US008186425B2

(12) United States Patent
Smart et al.

(10) Patent No.: US 8,186,425 B2
(45) Date of Patent: May 29, 2012

(54) SYMPATHETIC IGNITION CLOSED PACKED PROPELLANT GAS GENERATOR

(75) Inventors: Moises Enrique Smart, Houston, TX (US); Larry Grigar, East Bernard, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 95 days.

(21) Appl. No.: 12/391,711

(22) Filed: Feb. 24, 2009

(65) Prior Publication Data

US 2009/0223668 A1 Sep. 10, 2009

Related U.S. Application Data

(60) Provisional application No. 61/033,997, filed on Mar. 5, 2008.

(51) Int. Cl.

| | |
|---|---|
| ***E21B 29/02*** | (2006.01) |
| ***E21B 43/11*** | (2006.01) |
| ***F42B 3/00*** | (2006.01) |
| ***C06D 5/00*** | (2006.01) |

(52) U.S. Cl. ..... 166/63; 166/298; 102/320; 102/322; 102/530

(58) Field of Classification Search ..... 166/297, 166/298, 63; 102/313, 314, 317, 320, 322, 102/530

See application file for complete search history.

(56) References Cited

U.S. PATENT DOCUMENTS

| | | | | |
|---|---|---|---|---|
| 2,361,622 | A * | 10/1944 | Goulet | 102/322 |
| 3,244,099 | A * | 4/1966 | Lang et al. | 181/116 |
| 4,284,006 | A * | 8/1981 | Davis | 102/317 |
| 4,609,057 | A | 9/1986 | Walker et al. | |
| 4,633,951 | A * | 1/1987 | Hill et al. | 166/308.1 |
| 4,683,943 | A * | 8/1987 | Hill et al. | 166/63 |
| 4,716,832 | A * | 1/1988 | Sumner | 102/275.6 |
| 4,739,707 | A | 4/1988 | Regalbuto et al. | |
| 4,976,318 | A * | 12/1990 | Mohaupt | 166/311 |
| 6,508,176 | B1 * | 1/2003 | Badger et al. | 102/275.7 |
| 7,228,906 | B2 * | 6/2007 | Snider et al. | 166/299 |
| 7,487,833 | B2 * | 2/2009 | Grigar et al. | 166/297 |
| 7,762,189 | B2 * | 7/2010 | Ritchie et al. | 102/202.7 |
| 7,810,569 | B2 * | 10/2010 | Hill et al. | 166/299 |
| 2003/0101893 | A1 * | 6/2003 | Cord | 102/530 |
| 2003/0155112 | A1 * | 8/2003 | Tiernan et al. | 166/63 |
| 2006/0048664 | A1 * | 3/2006 | Tiernan et al. | 102/332 |
| 2007/0267195 | A1 * | 11/2007 | Grigar et al. | 166/297 |
| 2008/0121095 | A1 * | 5/2008 | Han et al. | 89/1.15 |
| 2009/0084535 | A1 * | 4/2009 | Bertoja et al. | 166/55.2 |

* cited by examiner

*Primary Examiner* — David Bagnell
*Assistant Examiner* — Catherine Loikith
(74) *Attorney, Agent, or Firm* — Chadwick A. Sullivan

(57) ABSTRACT

A downhole propellant gas generator includes a propellant assembly that comprises a plurality of individual lengths of an energetic material packed in a selected configuration and at least one initiator. A method for creating a pressure pulse includes igniting an initiator, wherein the one or more initiators are packed with a plurality of individual lengths of an energetic material in a propellant assembly; igniting the plurality of individual lengths of the energetic material subsequent to the igniting of the one or more initiators. A method for stimulating a well includes disposing in the well a propellant gas generator having a propellant assembly that comprises a plurality of individual lengths of an energetic material, and at least one initiator packed among the plurality of individual lengths of the energetic material; igniting the at least one initiator, which in turn ignites the plurality of individual lengths of the energetic material.

17 Claims, 3 Drawing Sheets

SYMPATHETIC IGNITION CLOSED PACKED PROPELLANT GAS GENERATOR

CROSS-REFERENCE TO RELATED APPLICATIONS

This claims the benefits, under 35 U.S.C. §109, of U.S. Provisional Application No. 61/033,997, filed on Mar. 5, 2008. This provisional application is incorporated by reference in its entirety.

BACKGROUND

1. Technical Field

Embodiments described in the present application relate to stimulating tools and methods of using the same in downhole stimulation applications, and more particularly to methods for controlling pressure pulses to enhance stimulation of a subterranean formation.

2. Background Art

There are several techniques for stimulating subterranean formations. The most commonly used technique is "hydraulic fracturing," in which a stimulation liquid (with an acid or proppants) is injected into a well under high pressure to fracture the formations. Alternatively, subterranean formations may be fractured by detonation of an explosive charge in the wellbore which fractures the formation by shattering the rock.

Another technique of well fracturing involves the use of a device incorporating a gas generating charge or propellant, which is typically lowered into a well on a wireline and ignited to generate a substantial quantity of gaseous combustion product at a pressure sufficient to break down the formation adjacent the perforations. This type of fracturing technique differs from explosive fracturing in a number of ways: (1) this type of fracturing is caused by high pressure gaseous combustion products moving through and splitting the formation rather than shock wave fracturing; and (2) the process is one of combustion rather than explosion. Solid propellant fracturing generates high pressure gases at a rate that creates fractures differently from high explosives or hydraulic fracturing.

Typically, gas generation stimulation tools include a propellant charge, generally in a perforated carrier, of a length that is easily handled. The propellants in these tools are generally ignited by an electrical signal transmitted through an insulated wireline to an assembly which contains a faster burning material which is more easily ignited.

After a fracture has been created, it is desirable that the fracture extend as deeply as possible in order to reach the producing region. In order to extend a fracture, there should be a source of energy applying pressure to the fluid driven by the initial detonation into the fracture. Therefore, solid propellants are typically selected for the production of pressures on the order of those required for propagating a fracture.

While these techniques have been useful in well stimulation, there exists a continuing need for stimulation techniques that can control the burn rate of a propellant and/or the peak pressures generated therefrom, in order to achieve a predetermined degree of stimulation.

SUMMARY

One aspect of the present application relates to downhole propellant gas generators. A downhole propellant gas generator in accordance with one embodiment includes a propellant assembly that comprises a plurality of individual lengths of an energetic material packed in a selected configuration; and at least one initiator.

Another aspect relates to methods for creating a pressure pulse downhole. A method in accordance with one embodiment includes igniting one or more initiators, wherein the one or more initiators are packed with a plurality of lengths of an energetic material in a propellant assembly; and igniting the plurality of lengths of the energetic material subsequent to the igniting of the one or more initiators.

Another aspect relate to methods for stimulating a well. A method in accordance with one embodiment includes disposing in the well a propellant gas generator having a propellant assembly that comprises a plurality of lengths of an energetic material, wherein the propellant assembly comprises at least one initiator packed among the plurality of lengths of the energetic material; and igniting the at least one initiator, which in turn ignites the plurality of lengths of the energetic material.

Other aspects and advantages will be apparent from the following description and the appended claims.

DETAILED DESCRIPTION

Embodiments relate to methods and apparatus for controlling pressure pulses generated by high energy gas produced by combustion of energetic materials. Energetic materials, for example, may include HMX, RDX, HNS, TATB, or others. Other energetic materials, for example, may comprise a combination of a fuel and an oxidizer. Methods according to embodiments may be used to tailor the pressure pulses to achieve, for example, a predetermined degree of stimulation.

In accordance with some embodiments, the pressure pulses resulting from combustion of energetic materials (or propellants) may be controlled by varying the geometry of the arrangements of the energetic materials. For example, by using a plurality of individual lengths of energetic materials, one would be able to pack these individual sticks in a selected configuration to achieve the desired topology and exposed surfaces. Thus, methods permit control of the geometry of individual lengths of the energetic materials to allow for control of the pressure pulses. Some embodiments relate to methods for controlling the pressure pulses by varying the packing densities, shapes, and sizes of individual grains of the energetic materials to achieve different combustion patterns.

In accordance with some embodiments, based on the close packing concept, the ignition of energetic materials in a propellant assembly can be made to ignite sympathetically, igniting at one point or multiple points within the assembly. When initiating at multiple points, the initiation may be performed simultaneously or sequentially (with very short delays between them). By controlling different patterns of ignition and varying the geometry, density, and amounts of the energetic materials, embodiments can provide flexible control of the pressure pulses.

Figure 3:
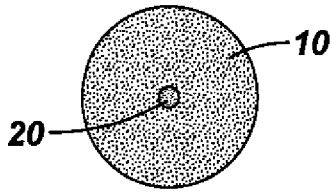
FIG. 3 (Prior Art)
FIG. 3 shows a cross section of a typical prior art propellant assembly.

As noted above, propellants are often used in the oilfield industry for stimulation purposes. Such a propellant may be a single solid stick of an energetic material. FIG. 3 shows an example of a conventional propellant assembly comprising a propellant 10, which is a solid stick having a detonating core (initiation cord) 20 disposed at the center. Other configuration of propellant assemblies are known in the art, see for example those disclosed in U.S. Pat. No. 7,431,075. Once the detonating core 20 is ignited, the ignition train may traverse the entire length of the propellant assembly to ignite all surrounding surface of the detonating core, followed by combustion of the propellant 10 to generate gas pressure.

Figure 1:
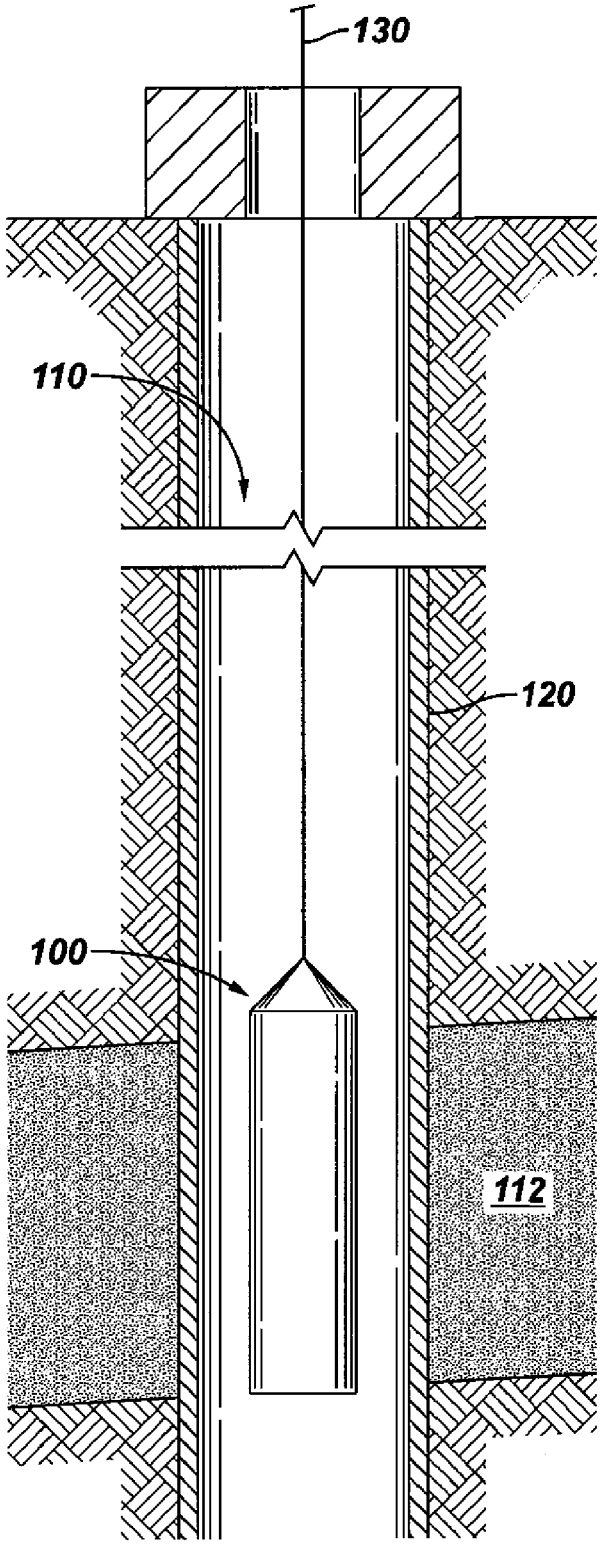
FIG. 1 shows a tool disposed in a wellbore penetrating a formation, wherein the tool includes propellant gas generator in accordance with one embodiment.

Typically, these propellants are loaded on a tool, which is then lowered into a wellbore. FIG. 1 illustrates a set up for using propellants to stimulate formations that have been penetrated by a well. As shown in FIG. 1, a gas generation tool 100, in accordance with embodiments, may be deployed in a well 110 having a target well zone 112 to perform fracturing operations. The well 110 may be supported by a casing 120 or other well tubular (e.g., liner, conduit, piping, and so forth) or otherwise an open or uncased well (not shown). The propellant assembly 100 may be deployed in the well 110 via any communication line 130 including, but not limited to, a wireline, a slick line, or coiled tubing. In operation, the propellant assembly 100 may be deployed in the well 110 to perform an operation at the target well zone 112.

Figure 2:
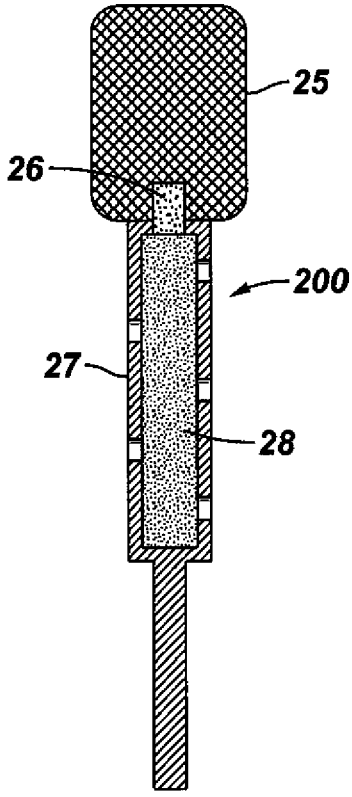
FIG. 2 shows a schematic of a propellant gas generator tool in accordance with one embodiment.

Any gas generation tools known in the art may be adapted for use with various embodiments. For example, FIG. 2 shows a gas generation tool 200 that includes a firing head 25, which may be connected to a signal wires or other trigger device. When a signal is sent to the tool to generate gas, the firing head 25 is ignited. Upon initiation of the firing head 25, a ballistic train proceeds through ballistic transfer unit 26 into the carrier 27 to ignite the propellant assembly 28 contained in the carrier 27. A conventional propellant assembly 28 may contain a solid propellant shown in FIG. 3. In accordance with embodiments, the propellant assembly 28 may comprises a plurality of individual lengths (individual sticks) of energetic materials arranged in a selected packing configuration, such as a square/rectangular packing configuration, a circular packing configuration, or a hexagonal packing configuration.

The burn rate and the peak pressure produced by an energetic material during the combination are proportional to the total surface area exposed to the flame at any particular time. Applicants have found that the recession rate, r, of the exposed surface is proportional to the pressure produced. Furthermore, by experiments, the Applicants have found that a relationship between the recession rate, r, and the pressure may be approximated as in Equation 1.

$$r \sim P^n \qquad \text{Equation 1:}$$

Where, P is the transient pressure of the combustion products (psi), and the burning index, n, may be experimentally determined. With energetic materials commonly used in oilfield operations, the burning index, n, is found to fall within the range of about 0.30 to about 1.25.

Based on these findings, embodiments are designed to provide means for controlling the rate of recession or the surface exposed on the energetic materials during combustion. For example, a method in accordance with embodiments for tailoring the rate of burning and/or the combustion pressures of a propellant assembly (e.g., a conglomerate of energetic material grains) may comprise varying the cross-sectional area, packing topology, and/or quantity of the grains in the conglomerate. These variations may be achieved with either homogeneous or heterogeneous stick dimensions (i.e., different sizes and/or shapes).

Therefore, in accordance with embodiments, a propellant assembly may comprise multiple propellant sticks (i.e., a plurality of individual lengths of an energetic material). The multiple energetic material lengths can be arranged in different packing configurations to vary the surface areas exposed to the flame during combustion to allow for control of the pressure pulses during combustion. Accordingly, embodiments include method for using different topology or geometries of individual lengths of energetic material arrangements to achieve control of burn rates and peak pressures during combustion.

Furthermore, some embodiments may include the use of one or more initiation cores (i.e., one or more initiation lengths) to achieve different patterns of initiation and burn. These initiation lengths may be arranged in any pattern within the closed packed configurations of energetic material lengths to allow for different patterns of initiation, and hence, different controls of the pressure pulses during the combustion of energetic materials.

Figure 4A:
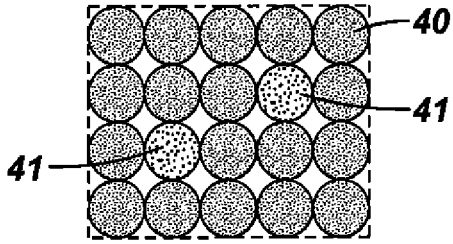
FIGS. 4A-4C show various packing configurations of individual lengths of an energetic material in a propellant assembly according to embodiments.
Figure 4B:
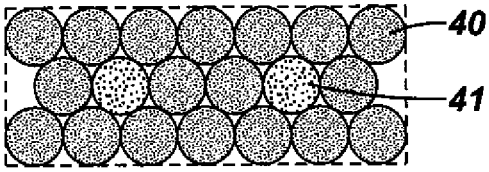
Figure 4C:
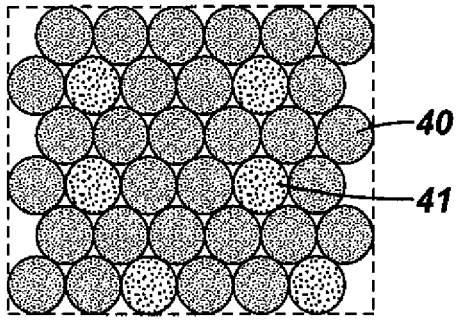

For example, FIGS. 4A-4C show three different examples of how energetic material lengths may be arranged in a propellant assembly in accordance with some embodiments. FIG. 4A shows a cross section of a propellant assembly, illustrating a square or rectangular packing configuration of round lengths of an energetic material 40, in which energetic material lengths 40 are lined up in a square or rectangular configuration. Each round length of energetic material 40 may be a stick of a selected length, which may or may not be the same for all lengths. In this description, the individual stick of an energetic material may be referred as a length of an energetic material or an energetic material length. As shown in FIG. 4A, the plurality of the lengths of energetic materials are tightly packed, with each energetic material length (stick) tangentially touching other neighboring energetic material lengths.

FIG. 4B and FIG. 4C show cross sections of examples of hexagonal packing configurations of individual energetic material lengths 40, in which energetic material lengths 40 are packed in an offset fashion between neighboring rows. One skilled in the art would appreciate that the hexagonal packing shown in FIG. 4B and FIG. 4C will have higher densities of the energetic material lengths (i.e., fewer voids), as compared with the square packing shown in FIG. 4A. Note that while these energetic material lengths are each shown to have a circular cross section, this is not intended to limit the scope of the claims. One skilled in the art would appreciate that other configurations of energetic material lengths (e.g., square or polygonal cross section) may also be used without departing from the inventive scope.

Among the various individual lengths of an energetic material, one or more may function as one or more lengths of initiators, which may comprise a different energetic material from that of the remaining lengths of energetic materials, see for example initiation lengths 41 in FIG. 4A, 4B, or 4C. In accordance with embodiments, one or more lengths of initiators 41 may be arranged among the multiple energetic material lengths (propellant lengths) in a selected configuration to achieve a single point or multiple point initiation.

Figure 5A:
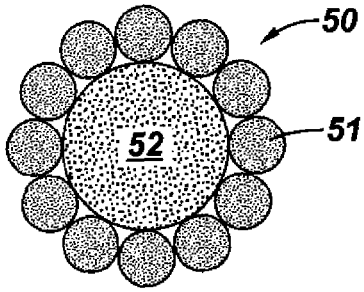
FIGS. 5A and 5B show various packing configurations of individual lengths of an energetic material in a propellant assembly according to other embodiments, illustrating different sizes of grains being used.
Figure 5B:
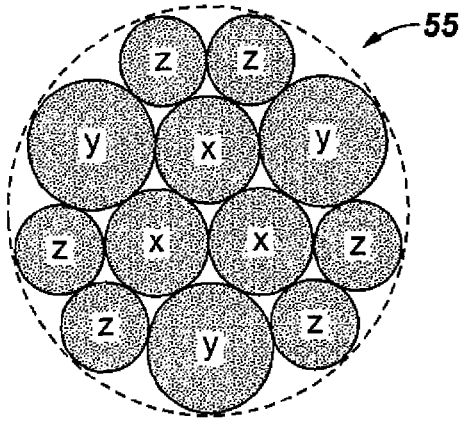
Figure 6A:
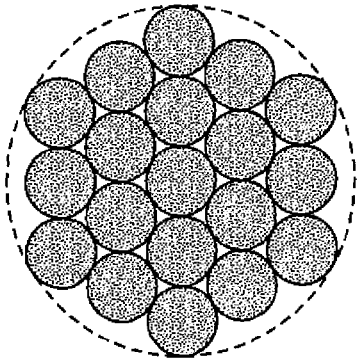
FIGS. 6A-6F show various packing configurations of individual lengths of an energetic material in a propellant assembly according to some embodiments.
Figure 6B:
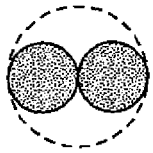
Figure 6C:
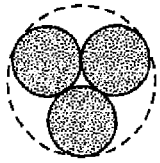
Figure 6D:
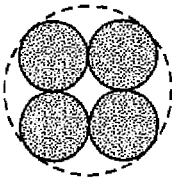
Figure 6E:
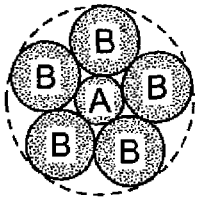
Figure 6F:
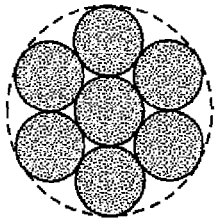

In accordance with some embodiments, a propellant assembly may comprise a plurality of individual lengths of an energetic material, wherein the individual lengths are of different dimensions (e.g., different sizes and/or shapes). For example, as shown in FIG. 5A, a propellant assembly 50 comprises multiple smaller energetic material lengths 51 arranged around a larger energetic material length 52. In FIG. 5B, a propellant assembly 55 comprises an arrangement of three different sizes of energetic material lengths, x, y, and z. Again, one or more of these energetic material lengths may be replaced with initiation lengths to achieve the desired pattern of initiation.

FIG. 6 shows more examples of other configurations of propellants assemblies in accordance with embodiments. Example A in FIG. 6 shows an example of a round propellant assembly comprising tightly packed energetic material lengths. Similarly, examples B, C, D, E, and F in FIG. 6 further illustrate other arrangements of energetic material lengths in a round propellant assembly. Example E also shows that such assembly may comprise energetic material lengths of different sizes. Again, one or more of these energetic material lengths may be replaced with initiation lengths to achieve the desired pattern of initiation.

The above examples shown in FIG. 4 through FIG. 6 are for illustration only. One skilled in the art would appreciate that other modifications or variations are possible without departing from the inventive scope.

Embodiments may include one or more of the following advantages. Methods according to embodiments provide flexible controls of pressure pulses during combustion of energetic materials, allowing the use of a solid propellant gas generator to achieve a predetermined degree of stimulation. In accordance with embodiments, the materials that form the solid propellant may comprise small propellant sticks to allow for packing of the energetic materials in the geometry and topology, to achieve different areas exposed to the flame during combustion. This allows for a fine control of the pressure pulses generated from the energetic materials. Furthermore, a propellant assembly may comprise one or more initiation grains to permit control of desired ignition patterns or to achieve sympathetic ignition. By using different packing of the individual grains of the solid propellant and different patterns of initiation grains, embodiments can achieve flexible control of the burn rates and peak pressures. Therefore, embodiments may be used to achieve the desired degree of stimulation of a well.

While various embodiments have been described herein with respect to a limited number of examples, those skilled in the art, having benefit of this disclosure, will appreciate that other embodiments and variations thereof can be devised which do not depart from the scope disclosed herein. Accordingly, the scope of the claims should not be unnecessarily limited by the present disclosure.

What is claimed is:

1. A downhole propellant gas generator, comprising:

a firing head;

a ballistic transfer unit connected with the firing head;

a propellant assembly that is connected with the ballistic transfer unit;

a plurality of individual lengths of a propellant of the propellant assembly;

an initiator of the propellant assembly packed with the plurality of individual lengths of the propellant in a selected configuration; and an energetic material of the initiator different from the propellant.

2. The downhole propellant gas generator of claim 1, wherein the propellant assembly comprises only one initiator.

3. The downhole propellant gas generator of claim 1, wherein the initiator comprises a firing head.

4. The downhole propellant gas generator of claim 1, wherein the selected configuration is a square or rectangular packing configuration.

5. The downhole propellant gas generator of claim 1, wherein the selected configuration is a circular packing configuration.

6. The downhole propellant gas generator of claim 1, wherein the selected configuration is a hexagonal packing configuration.

7. The downhole propellant gas generator of claim 1, wherein the plurality of individual lengths of the energetic material have different dimensions.

8. The downhole propellant gas generator of claim 7, wherein the propellant assembly comprises more than one initiator.

9. A method for creating a pressure pulse downhole, comprising:

igniting a firing head, wherein the firing head ignites a ballistic transfer unit that ignites a propellant assembly thereby causing the propellant assembly to detonate, the propellant assembly comprising one or more initiators and a plurality of individual lengths of propellant, the one or more initiators and the plurality of individual lengths of propellant packed in a selected configuration; and igniting the plurality of individual lengths of the propellant subsequent to the igniting of the one or more initiators, the one or more initiators including an energetic material different from the propellant.

10. The method of claim 9, wherein the igniting one or more initiators comprises igniting more than one initiator.

11. The method of claim 10, wherein the igniting of one or more initiators comprises igniting the initiators simultaneously.

12. A method for stimulating a well, comprising:

disposing in the well a propellant gas generator having a propellant assembly that comprises a plurality of individual lengths of propellant material and at least one initiator arranged in a selected configuration, and a firing head connected with a ballistic transfer unit, the ballistic transfer unit connecting with the at least one initiator; and igniting the at least one initiator, which in turn ignites the plurality of individual lengths of the propellant, the one or more initiators including an energetic material different from the propellant.

13. The method of claim 12, wherein the igniting of one or more initiators comprises igniting more than one initiator.

14. The method of claim 13, wherein the igniting of more than one initiator comprises igniting the initiators simultaneously.

15. The method of claim 12, wherein the selected configuration is a square or rectangular packing configuration.

16. The method of claim 12, wherein the selected configuration is a hexagonal packing configuration.

17. The method of claim 12, wherein the plurality of individual lengths of the propellant materials are of different dimensions.

* * * * *